US010435988B2

(12) United States Patent
Steib

(10) Patent No.: US 10,435,988 B2
(45) Date of Patent: Oct. 8, 2019

(54) WIRELINE DRILLING TOOL

(71) Applicant: Guy B. Steib, Thibodaux, LA (US)

(72) Inventor: Guy B. Steib, Thibodaux, LA (US)

( * ) Notice: Subject to any disclaimer, the term of this patent is extended or adjusted under 35 U.S.C. 154(b) by 88 days.

(21) Appl. No.: 15/530,900

(22) Filed: Mar. 20, 2017

(65) Prior Publication Data

US 2018/0266213 A1 Sep. 20, 2018

(51) Int. Cl.
*E21B 37/02* (2006.01)
*E21B 10/44* (2006.01)

(52) U.S. Cl.
CPC ..... *E21B 37/02* (2013.01); *E21B 10/44* (2013.01)

(58) Field of Classification Search
None
See application file for complete search history.

(56) References Cited

U.S. PATENT DOCUMENTS 1,388,545 A * 8/1921 Bohan ..... F42B 23/00 102/362
1,647,961 A * 11/1927 Smith ..... E21B 6/00 175/322
2,117,050 A * 5/1938 Wilson ..... E21B 29/005 166/55.7
2,464,390 A 3/1949 Hammer
2,786,218 A * 3/1957 Yousem ..... E03C 1/302 15/104.33
4,061,197 A * 12/1977 Skidmore, Jr. ..... E21B 4/14 175/101
4,189,000 A 2/1980 Best
4,651,837 A * 3/1987 Mayfield ..... E21B 10/66 175/260
4,706,748 A 11/1987 Harris
(Continued)

*Primary Examiner* — Shane Bomar
(74) *Attorney, Agent, or Firm* — Michael D. Carbo

(57) ABSTRACT

A mechanical drilling and removal tool and method for use in wireline and other operations for drilling through and removing paraffin, scale and other deposits from tubing in oil wells, all without the need for any electrical or hydraulic input to the tool, the tool comprising: (a) a tool body having an outer surface removably engageable with the inner wall of oil well tubing and having a threaded inner surface for receiving a threaded shaft, the outer surface of the tool body being engageable with the inner wall of oil well tubing when a rapid dynamic upward force is applied to the tool body and being disengageable when a steady upward force is applied; (b) a threaded shaft having a head end, a threaded body, and a threaded bit end and having the body threads complementary to the threaded inner surface of the tool body, the shaft being movable longitudinally downward through the tool body when a downward force is applied to the head end while the tool body is engaged with the inner wall of oil well tubing, thereby causing the shaft to rotate within the tool body and causing the threaded bit end to drill into and collect between paddle threads on the bit a deposit disposed below the tool body; and (c) a ratchet, attached to the head end portion of the shaft, to prevent the shaft from rotating when the shaft is moved longitudinally upward, thereby allowing the entire drilling and removal tool, along with the collected deposit, to be removed from the oil well tubing when a steady upward force is applied to the head end of the shaft. The bit can be a separate piece removably connected to the threaded shaft.

9 Claims, 8 Drawing Sheets

(56) References Cited

U.S. PATENT DOCUMENTS

| | | | | |
|---|---|---|---|---|
| 4,949,795 | A * | 8/1990 | McDonald | E21B 7/002 175/323 |
| 5,000,260 | A | 3/1991 | Fontenot | |
| 5,119,889 | A * | 6/1992 | Wiggs | E21B 7/26 175/19 |
| 2002/0020560 | A1* | 2/2002 | Bratton | E21B 7/26 175/20 |
| 2008/0135226 | A1* | 6/2008 | Lewis | E21B 29/005 166/55 |
| 2016/0230508 | A1* | 8/2016 | Jensen | E21B 37/02 |
| 2018/0016860 | A1* | 1/2018 | Stangeland | E21B 37/02 |

* cited by examiner

WIRELINE DRILLING TOOL

CROSS-REFERENCE TO RELATED APPLICATIONS

None

BACKGROUND OF THE INVENTION

1. Field of the Invention

The present invention relates to devices of the type used for petroleum production, more specifically, those for drilling through paraffin and other deposits in tubing in oil wells and then removing the deposits from the well.

2. Background Art

Ever since the production of crude oils began in the Pennsylvania oilfields, paraffin deposits in well bores and flow lines have been a problem. Paraffin is a waxy product found in most crude oil. When kept at formation temperatures (above 50° C.) it is a liquid and is not an issue. But when the crude cools, including when it flows toward the surface during oil production, the paraffin becomes a solid (forms wax) and it falls out of suspension. In the oil extraction industry, paraffin wax and asphaltene build-up in production tubing has an adverse effect on oil well production. The wax will accumulate on the interior of the tubing of a producing well and reduce the efficiency of the flow of oil and can ultimately block the flow of oil completely. The temperature gradient in producing oil wells is such that wax is usually only a problem only within the first few thousand feet below the surface of the well Left untreated or unremoved, paraffin and other build-up can drastically decrease the efficiency of the entire oil recovery and transfer system.

A range of methods exists for removing paraffin wax build-ups in oil wells including mechanical, scraping, coiled tubing, thermal, hot oiling, hot water, chemical wax solvents and dispersants, and combinations of mechanical or thermal methods. Operators have available a variety of treating possibilities, but no universal solution has ever been found and the paraffin problem is as insidious today as it was over 100 years ago. With most methods there will be case histories of successful use and instances of total failure. Unless the problem warrants a specific study, most solutions are found by trying procedures until one is successful.

The cost of wax removal operations, particularly those operations that require specialized methods or tools that are not or cannot be made routinely available on a production rig or platform, makes wax removal expensive. Because the rate of wax build-up is often unpredictable, wax removal operations that require specialized equipment to travel to a producing well must either be scheduled with some frequency or else be used on demand, thereby increasing costs, or more convenient ad hoc tools or methods must be used. A tool that can be housed on a rig or platform, that is uncomplicated to use, and that is effective and efficient is desirable.

There has been an abundance of prior patent art for special complicated tools with a number of the tools being commercially available—usually on a temporary lease or rental basis. Mechanical scrapers fastened to the rod string through the zone of paraffin deposition (normally near the surface) have been used to keep oil well tubing free of paraffin. Prior devices used to scrape and clean the inside of well casing have employed the rotational effects brought about from using a string of drilling pipe. These devices necessitated the use of rotary drilling equipment. Substantial time and effort is required to assemble the pipe string necessary to carry out a scraping operation with rotary apparatus. Piping scrapers attached to wirelines, which are cables for lowering and raising tools and other equipment within a well shaft, allow greater speed and consequently less expense.

Subsequent devices used to scrape and clean the inside of well casing did not require the use of rotational equipment but rather depended upon a cutting or scraping action while being pulled up through the well casing. However, these devices suffered from other serious drawbacks. Chief among these drawbacks was the inability to compensate for immoveable restrictions inside the casing pipe while the scraping device was being raised during its pipe scraping mode. The various weights of the casing material used in a particular well result in varying internal diameters to be cleaned by the casing scraper. The scraper would pass through an obstruction in a downward direction but become lodged when the scraper was pulled upwards to scrape the casing wall. Being unable to compensate for immoveable restrictions, the scraping device would often have to be discarded in the well casing.

Various attempts have been made to provide casing scraper devices capable of scraping various pipe diameters. U.S. Pat. No. 2,464,390 to Hammer and U.S. Pat. No. 4,189,000 to Best teach the use of spring means compressed between the mandrel and a plurality of cutting blades, the spring pushing the cutting blade toward the inside casing wall. The arrangement of the plurality of cutting blades and springs necessarily involved results in a complicated structure, each tool having a necessarily limited range of internal casing diameters which can be cleaned. Additionally, should the scraping device extend beyond the lower end of the pipe, the tools cannot be recovered due to the extension of the cutting blades beyond the diameter of the casing.

The prior scraping devices which depend on spring biasing have not historically been capable of withstanding the adverse loads encountered in operation. Due to the necessarily limited size of the spring devices, they are prone to failure.

U.S. Pat. No. 4,706,748 to Harris teaches a pipe scraping device attached to a cable which allows the scraper blades to retract when the device is moved downward. However, the scraping device does not allow for retraction of the blades when the device is being raised during its pipe scraping mode. The scraping device may thus pass an immoveable obstruction while moving down the hole and be prevented from passing the obstruction while being pulled up the hole. U.S. Pat. No. 5,000,260 to Fontenot teaches a casing scraper for use in oil and gas wells having scraping blades which may be retracted during upward movement of the scraping device to allow movement past immoveable restrictions.

Generally the tools that have been proposed that are simple in construction and low in expensiveness have failed to work satisfactorily while the complicated tools have often involved expensive outlays that were excessive for rehabilitation of marginal low grade wells. There has therefore been a long continuing need for a very simple durable paraffin scraping and removal tool that is so inexpensive in cost and indestructible in structure as to permit the tool to remain in place semi-permanently concurrently with continued pumping production of the well.

BRIEF SUMMARY OF THE INVENTION

Objects of the Invention

A primary object of the invention is to devise a simple, durable and inexpensive paraffin removal tool that can be run in a wireline downhole in oil well tubing to cut and retain paraffin and other deposits and allow them to be brought to the surface for removal from the well.

A further object of this invention is to provide a deposit removal tool that can releasably engage with the interior tube wall.

It is also an object of the invention is to provide a drilling tool that operated without rotary motion of the wireline string along which it is attached.

Another object of the invention is to provide an inexpensively manufactured and uncomplicated-to-operate paraffin removal tool that makes it practical and efficient for a well operator to run the tool repeatedly downhole on a wireline to cut through, collect and bring to the surface paraffin and other deposits without the need for hydraulic or electrical actuation of the tool.

It is a further object of this invention to provide a deposit removal tool that does not require fluid circulation to remove cut deposits from the well.

These and other objects and advantages of this invention are apparent from the following description which follows when taken in conjunction with the following description of the embodiments and which are contained in and illustrated by the various drawing figures, or which may be recognized by practice of the invention.

BRIEF DESCRIPTION OF THE DRAWING FIGURES

BRIEF DESCRIPTION OF THE INVENTION

Figure 1:
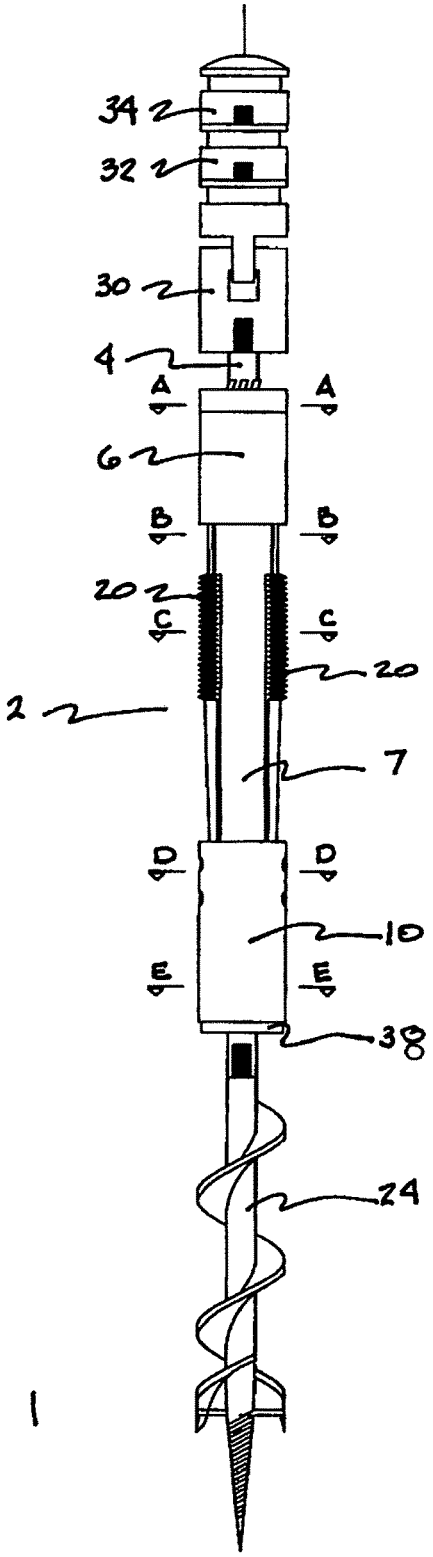
FIG. 1 is a side view of a wireline drilling tool according to an embodiment of the invention, showing the tool on a wireline string with a spang jar, a dummy weight, and a wireline rope socket.
Figure 2:
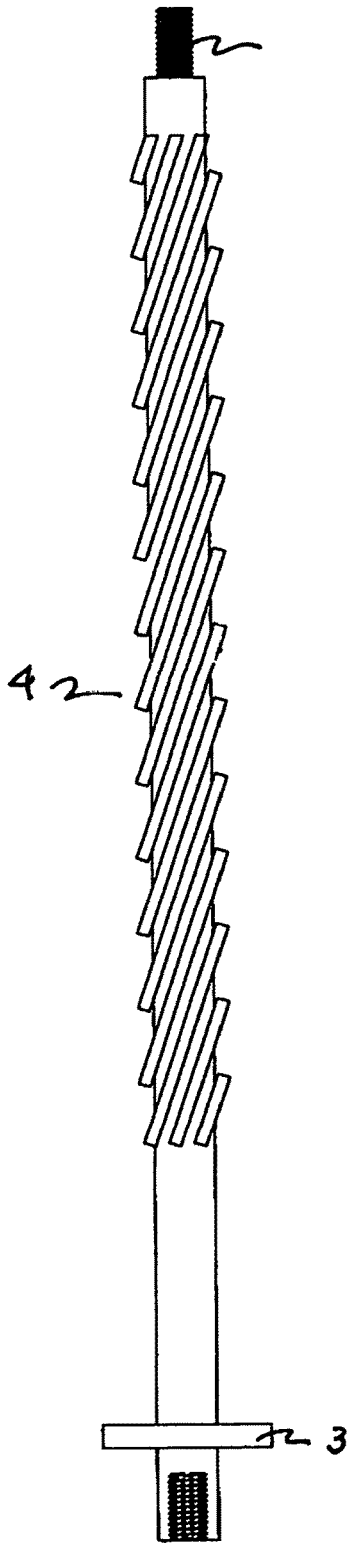
FIG. 2 is a longitudinal side view of the central threaded shaft of a wireline drilling tool according to an embodiment of the invention.
Figure 3:
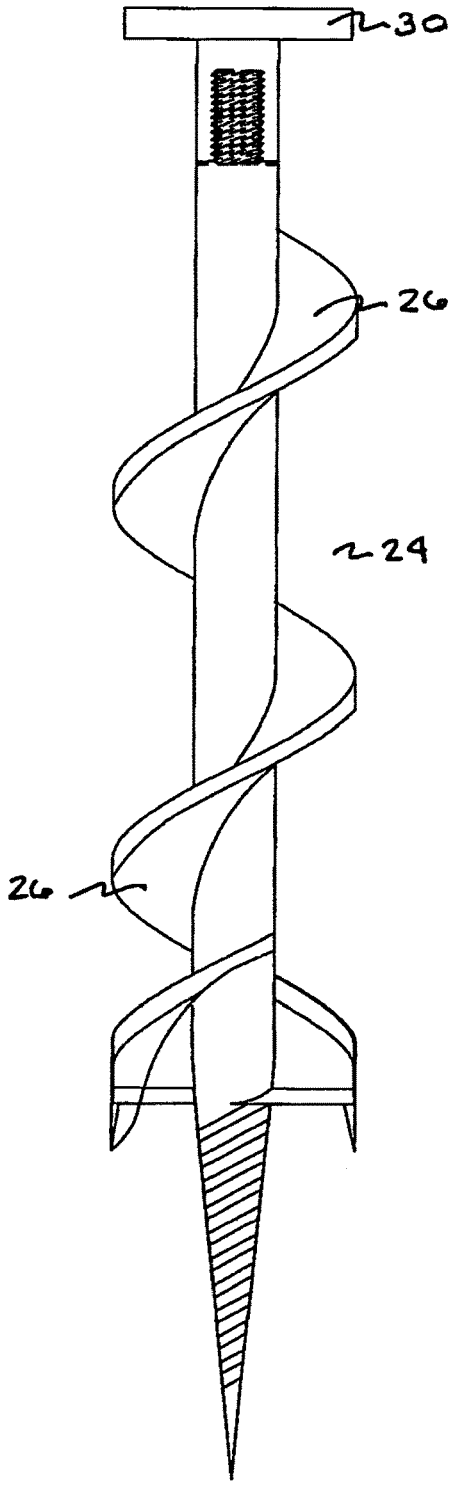
FIG. 3 is a longitudinal side view of a threaded bit according to an embodiment of the invention.

Accordingly, a wireline drilling tool is provided, comprising (1) a tool body, (2) a threaded shaft having a head end portion, a threaded central portion, and a bit end portion, and (3) a ratchet. The drilling tool is shaped and configured to be placed on a wireline string and lowered within tubing above and in proximity to paraffin or other deposits. The tool body has a portion of its outer surface, comprising mechanical dogs that are selectively engageable and disengageable with the inner wall of the tubing, engageable by applying force to the tool body by means of conventional spang jars. Once the tool body is set against the tubing wall, drilling is begun by reciprocating the spang jars up and down to impact the threaded shaft and turning the bit, which has threads shaped like an auger. The threads on the shaft also catch on the bottom plate and force the dogs outward, locking the dogs to the inner tubing wall. The deposit is drilled into and accumulates between the auger threads (also called auger paddles).

After the drilling is complete and deposit is collected on the auger paddles, the shaft is pulled upward, which will cause the bottom plate to loosen, thereby releasing the dogs and disengaging the tool body from the inner tubing wall. The ratchet prevents the threaded shaft from rotating opposite to its drilling rotation The tool can be pulled out of the tubing, cleaned, and run downhole again.

The threaded shaft is rotatable within the tool body because the threads are complementary to an inner longitudinal surface of the tool body. The pitch of the shaft threads is selected so that the shaft can rotate within the tool body when downward force is applied by the spang jars.

The ratchet is engaged with the head section of the shaft to prevent the shaft from rotating relative to the tool body when the shaft is moved upward, thereby allowing the drilled deposit to be removed from the tubing when the drilling tool is removed from the tubing. This prevents the deposit from being wiped off of the auger paddles. The ratchet allows the drilled deposit to be brought to the surface without having to circulate fluids.

Further, a method of removing paraffin and other deposits is provided involving the acts of engaging a drilling tool on the inner wall of tubing, drilling into and collecting deposits, disengaging the drilling tool from the inner wall, and moving the collected deposits out of the tubing when the tool is removed from the tubing.

In summary, to operate the method of the invention, rig up spang jars with a pre-calculated amount of weight screwed on top of the jars with the wireline drill screwed to the bottom of the jars. With the rope socket (wire itself) screwed into the top of the weight, lower the tool into well until the obstruction is tagged, thereby locating it. Sharply jerk upward setting the dogs into the walls of the tubing (which is attached to the complimentary treaded shaft, thereby making this part stationary. Begin drilling by reciprocating the jars impacting the shaft and turning the bit. The threads will also catch on a bottom plate attached to the dogs forcing the dogs outward and locking the tool body to the tubing wall. Once drilling is complete, pulling the shaft back up the hole in the opposite direction will cause the bottom plate to loosen and will release the dogs. The tool can now be pulled out of the hole, cleaned, and run again.

DETAILED DESCRIPTION OF AN ILLUSTRATIVE EMBODIMENT

For promoting an understanding of the principles of the invention, reference will now be made to the embodiment illustrated in the several views of the drawing and specific language will be used to describe the invention. For brevity, like elements and components will be given the same designation throughout the figures. It will nevertheless be understood that no limitation on the scope of the invention is thereby intended, such alterations and further modifications in the illustrated device and such further application of the principles of the invention as illustrated therein being contemplated as would normally occur to one skilled in the art to which the invention relates.

Figure 4:
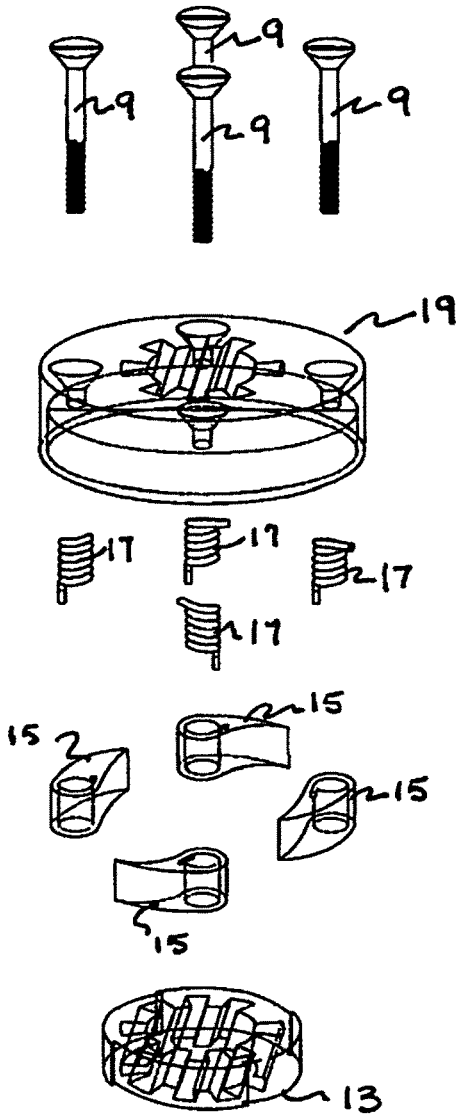
FIG. 4 is an exploded view of a ratchet according to an embodiment of the invention.
Figure 4:
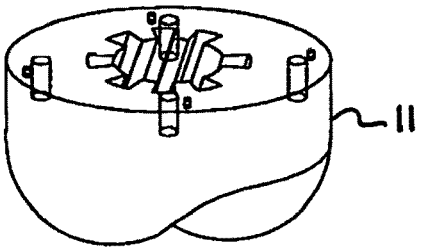
Figure 5:
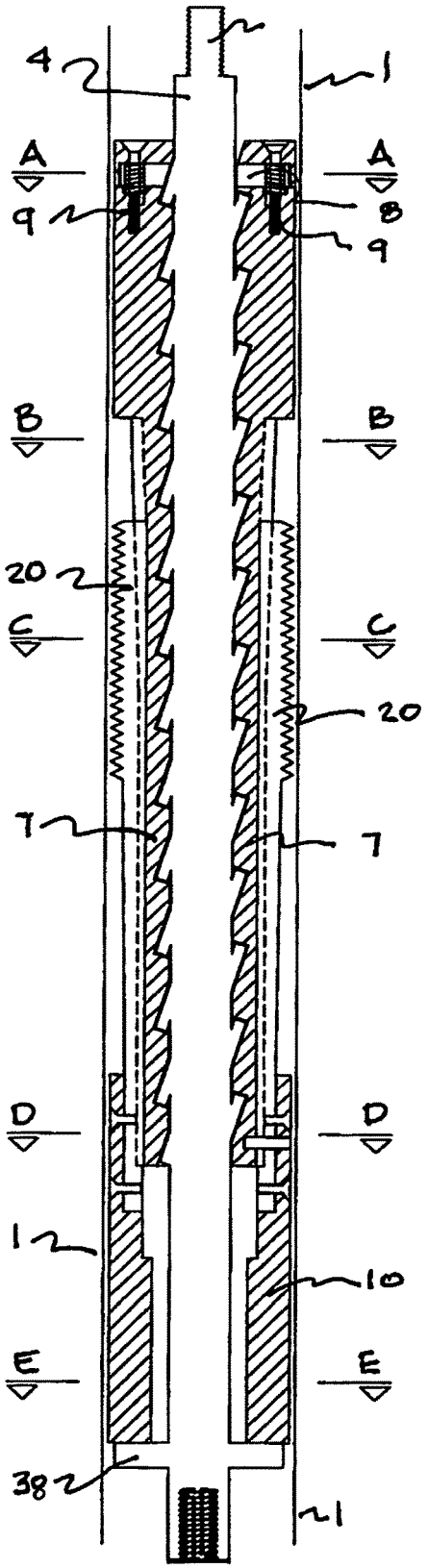
FIG. 5 is a cutaway longitudinal view of a tool body of a wireline drilling tool according to an embodiment of the invention, showing a ratchet attached to a top end portion of the tool body.

Referring to FIG. 5, a wireline drilling tool is shown in an illustrative embodiment disposed within tubing 1. Tool body 2 and threaded shaft 4 are shown in FIG. 1 with shaft 4 inserted into tool body 2. Tool body 2 has top end portion 6, longitudinal central portion 7, and bottom portion 10. Shaft 4 has head portion 20, central threaded portion 22, and bit end portion 24. Bit end portion is preferably a separate piece affixed to threaded portion 22. Top end portion 6 of tool body 2 has ratchet 8 affixed thereto by screws 9. The components of ratchet 8 are shown more clearly in FIG. 4, including base plate 11, cog 13, pawls 15, springs 17, and top plate 19.

Figure 6:
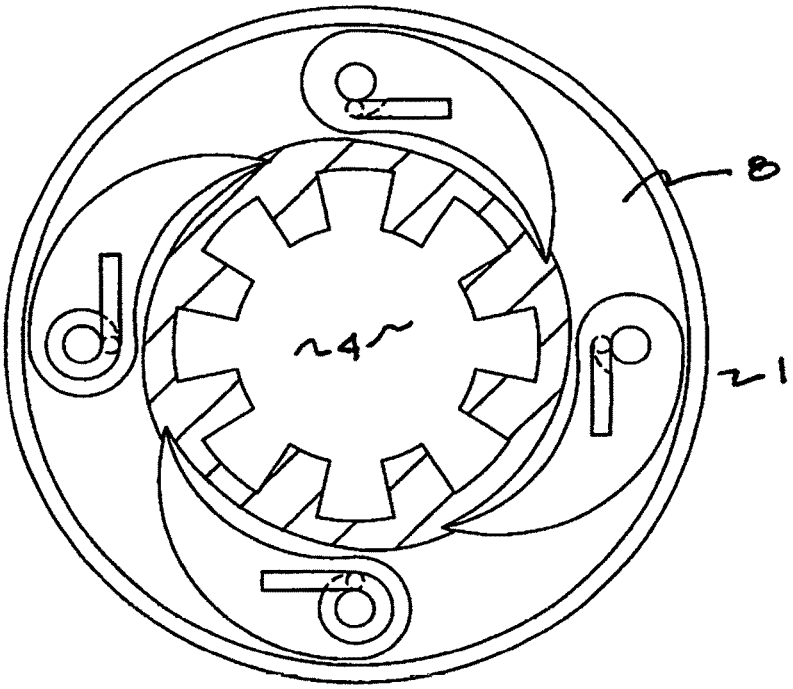
FIG. 6 is a top axial view, taken along cut line A-A of FIG. 5, of a top central portion of the tool body according to an embodiment of the invention, showing a ratchet.
Figure 7:
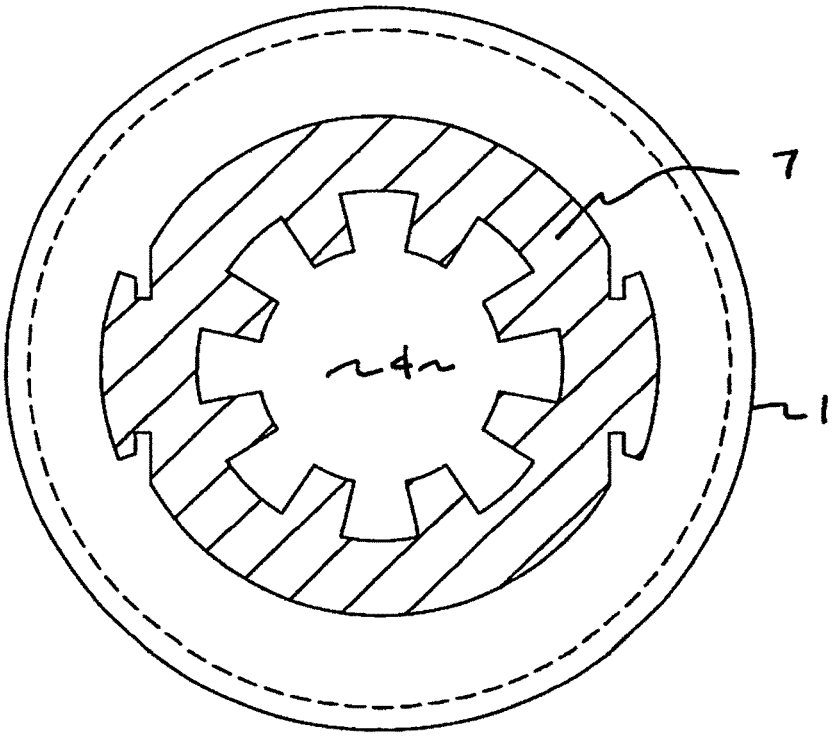
FIG. 7 is a top axial view, taken along cut line B-B of FIG. 5, of a top central portion of the tool body according to an embodiment of the invention, showing a portion of the threaded shaft and the outer surface of the tool body.
Figure 8:
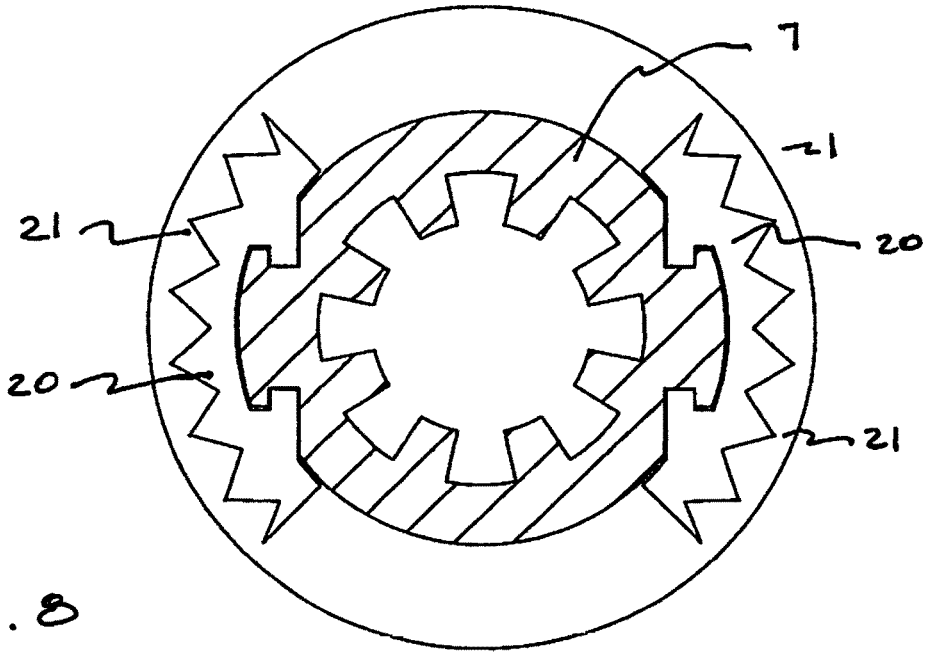
FIG. 8 is a top axial view, taken along cut-line C-C of FIG. 5, of a portion of the wireline drilling tool according to an embodiment of the invention, showing dogs, which selectively engage and disengage, in a disengaged position.
Figure 9:
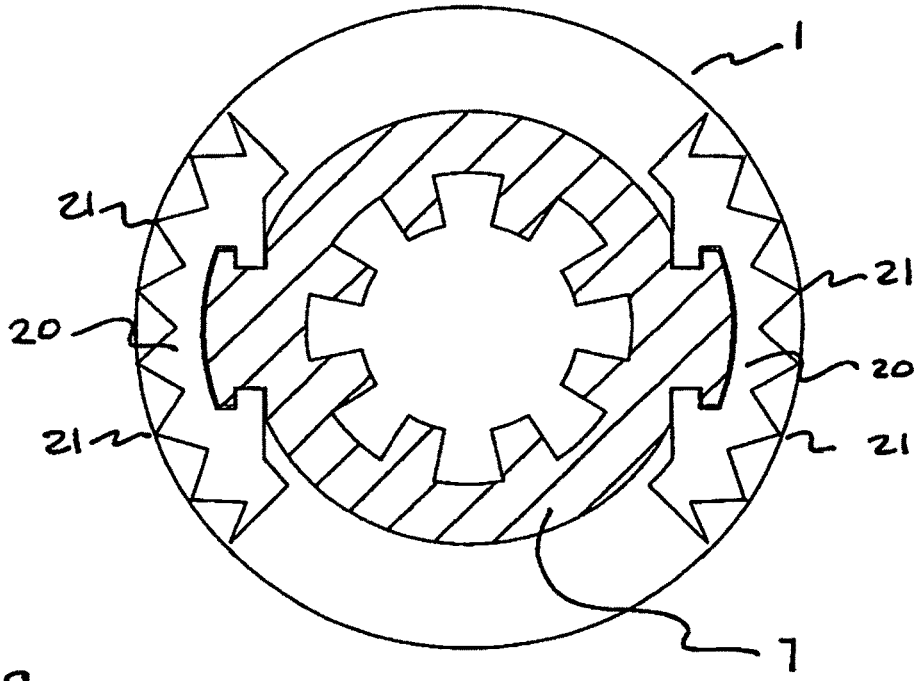
FIG. 9 is a top axial view, taken along cut-line C-C of FIG. 5, of a portion of the wireline drilling tool according to an embodiment of the invention, showing dogs, which selectively engage and disengage, in an engaged position.
Figure 10:
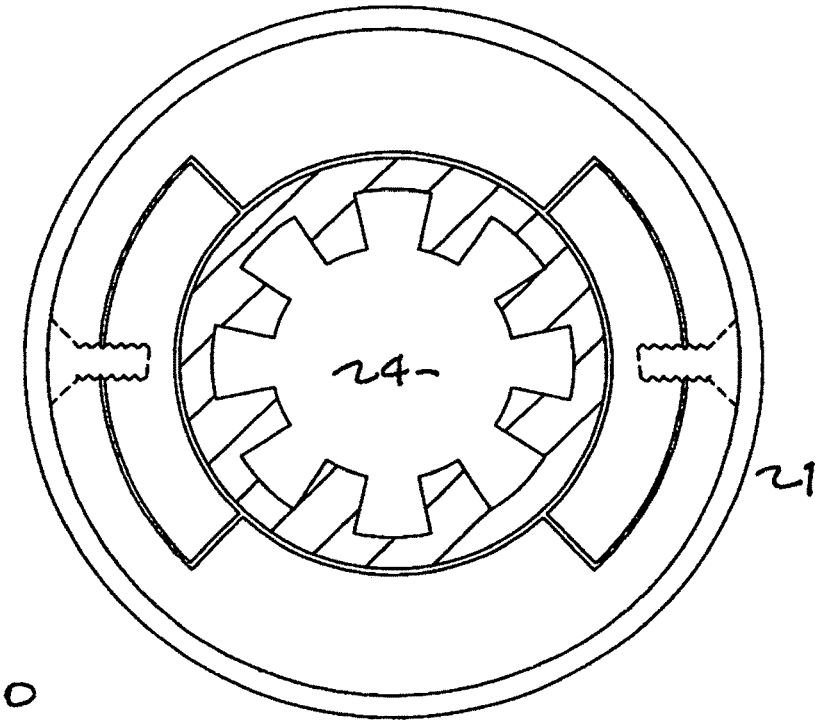
FIG. 10 is a top axial view, taken along cut-line D-D of FIG. 5, of a portion of the wireline drilling tool according to an embodiment of the invention, showing a portion of the outer surface of the tool body connected by a pair set screws to the engaging mechanism portion of the tool body.
Figure 11:
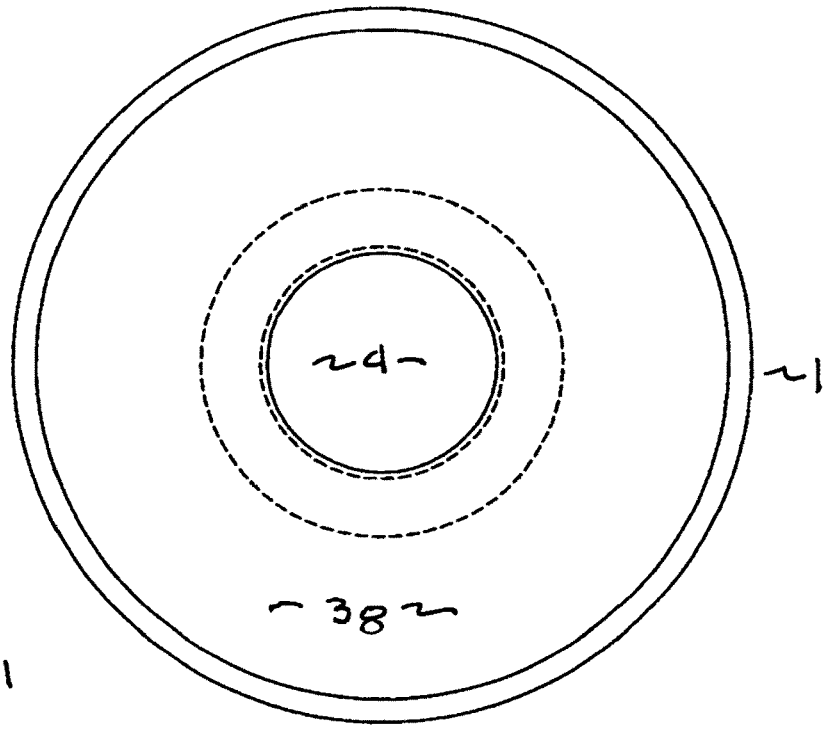
FIG. 11 is a top axial view of a bottom plate which assists in engaging the dogs.

Shaft 4 is inserted through ratchet 8. Ratchet 8 permits shaft 4 to turn in one direction and pawls 15 substantially prevent rotation in an opposite direction, as shown in FIG. 6.

Central portion 7 of tool body 2 contains toothed dogs 20 with tips 21 shaped to engage inner tubing 1 to immobilize tool body 2 against tubing 1. Dogs 20 are actuated to engage tubing 1 by loads imposed by a conventional spang jar 30 with a pre-calculated amount of weight 32 affixed on top of spang jar 30 with the wireline drill screwed to the bottom of jar 30 and rope socket 34, attached to the wire itself, screwed on top of the weight. Rapidly dynamically applying upward force on spang jar 30 jerks shaft 4 upward, ratchet 8 prevents shaft 4 from rotating to back out of tube body 2, and the teeth of dogs 20 are set into the inner wall of tubing 1, thereby affixing tool body 2 to the inner wall of tubing 1.

Once tool body 2 is immobilized against the inner wall of tubing 1, drilling can begin. Reciprocating spang jar 30 up and down applies force to shaft 4. The downward force causes shaft 4 to rotate and move downward, causing bit end portion 24 to drill into deposits below tool body 2. Auger paddles 26 collect deposits between the threads thereof. The threads of shaft 4 also catch on bottom plate 38 and lock dogs 20 onto the inner wall of tubing 1.

After deposit is collected, the wireline string can be pulled upward out of the hole. Ratchet 8 prevents substantial rotation of shaft 4 relative to tool body 2, so shaft 4 does not back out of tool body 2 and the collected deposit is not wiped away. Ratchet 8 is preferably indexed to allow engagement setting of dogs 20 and also to allow disengagement of dogs 20. The upward pull on shaft 4 causes shaft 4 to move slightly away from bottom plate 38, thereby releasing dogs 20 and disengaging tool body 2 from the inner wall of tubing 1 and permitting the entire wireline drilling tool to be removed from downhole along with the collected deposits.

What is claimed is:

1. A tool for use in a wireline string for drilling through and removing deposits from tubing walls, comprising:

(a) a tool body having an outer surface comprising means for engaging and disengaging the tool with an inner wall of tubing and having an inner longitudinal surface complementary to a threaded shaft;

(b) a threaded shaft, rotatable within the tool body, the shaft having a head section, a threaded section, and a bit section, the threaded section complementary to the inner surface of the tool body so that, as the shaft is moved longitudinally downward through the tool body, it rotates in a direction that causes the bit section to drill into a deposit below the tool body; and (c) ratchet means engaged with the head section of the shaft to substantially prevent the shaft from rotating relative to the tool body when the shaft is moved upward, thereby allowing the drilled deposit to be removed from the tubing when the drilling tool is removed from the tubing.

2. The tool according to claim 1, wherein the bit section is a separate piece removably connected to the threaded shaft.

3. The tool according to claim 1, wherein the engaging and disengaging means comprises dogs actuated for engagement by rapid dynamic upward force applied to the tool body and actuated for disengagement by a steady upward force applied to the tool body.

4. The tool according to claim 1, wherein the ratchet means comprises a pawl and cog arrangement.

5. A method for removing paraffin and other deposits from tubing walls, comprising the acts of:

(a) placing, above and in proximity to a deposit in tubing, a drilling tool, the tool comprising a tool body and a separate threaded shaft, the threaded shaft having a head section, a threaded section, and a bit section having threads, the threads of the bit section being formed by auger paddles thereon;

(b) setting an outer surface of the tool body against the inner wall of the tubing;

(c) moving the threaded shaft downward through a complementary inner surface of the set tool body to allow the threaded bit section of the threaded shaft to drill into the deposit below the tool body and collect the deposit between the threads formed by the auger paddles; and (d) moving the threaded shaft upward without substantial relative rotation between the threaded shaft and the tool body to remove deposit collected between the paddle threads of the bit as the tool is removed from the tubing.

6. A tool for use in a wireline string for drilling through and removing deposits from tubing walls, comprising:

(a) a tool body having an outer surface comprising means for engaging and disengaging the tool with an inner wall of tubing and having an inner longitudinal surface complementary to a threaded shaft;

(b) a threaded shaft, rotatable within the tool body, the shaft having a head section, a threaded section, and a bit section, the threaded section complementary to the inner surface of the tool body so that, as the shaft is moved longitudinally downward through the tool body, it rotates in a direction that causes the bit section to drill into a deposit below the tool body; and (c) means for substantially preventing the shaft from rotating relative to the tool body when the shaft is moved upward, thereby allowing the drilled deposit to be removed from the tubing when the drilling tool is removed from the tubing.

7. The tool according to claim 6, wherein the bit section is a separate piece removably connected to the threaded shaft.

8. The tool according to claim 6, wherein the means for substantially preventing the shaft from rotating relative to the tool body when the shaft is moved upward comprises dogs actuated for engagement by rapid dynamic upward force applied to the tool body and actuated for disengagement by a steady upward force applied to the tool body.

9. The tool according to claim 6, wherein the means for substantially preventing the shaft from rotating relative to the tool body when the shaft is moved upward comprises a pawl and cog arrangement.

* * * * *